US005575415A

United States Patent [19]

Sucher

[11] Patent Number: 5,575,415

[45] Date of Patent: Nov. 19, 1996

[54] STAPLER APPARATUS AND METHOD FOR SELECTIVELY DISPENSING A PLURALITY OF DIFFERENT SIZE STAPLES

[76] Inventor: Richard Sucher, 23611 Elkwood, West Hills, Calif. 91304

[21] Appl. No.: 190,761

[22] Filed: Feb. 2, 1994

[51] Int. Cl.[6] ..... B27F 7/00; B25C 5/16

[52] U.S. Cl. ..... 227/109; 227/120

[58] Field of Search ..... 227/109, 119, 227/120, 129, 128, 107

[56] References Cited

U.S. PATENT DOCUMENTS

| | | | |
|---|---|---|---|
| 3,855,688 | 12/1974 | Knohl | 227/109 X |
| 3,958,738 | 5/1976 | Tremblay | 227/109 |
| 4,139,136 | 2/1979 | Catalano | 227/109 |
| 4,304,349 | 12/1981 | Novak et al. | 227/109 |

FOREIGN PATENT DOCUMENTS

| | | | |
|---|---|---|---|
| 180568 | 7/1980 | Japan | 227/109 |

*Primary Examiner*—Rinaldi I. Rada
*Assistant Examiner*—Boyer Ashley
*Attorney, Agent, or Firm*—John J. Posta, Jr.

[57] ABSTRACT

A stapler and related method for use to bind documents are disclosed in which a selective one of a plurality of different size staples all stored within the stapler itself may be selected for dispensing without necessitating the removal of any staples of a non-selected size from the stapler, or reloading the stapler with the selected size of staples. The stapler contains a magazine having a plurality of cassettes into which staples of different sizes are loaded, with the cassettes being located one atop the other in a stacked array of rows of staples. A selector mechanism is used to alternately, selectively allow one of the rows of staples to be fully advanced to the end of the stapler from which the staples are dispensed, with the other rows of staples being actively urged back away from the end of the stapler from which the staples are dispensed to allow a staple from the selected row to be dispensed.

19 Claims, 6 Drawing Sheets

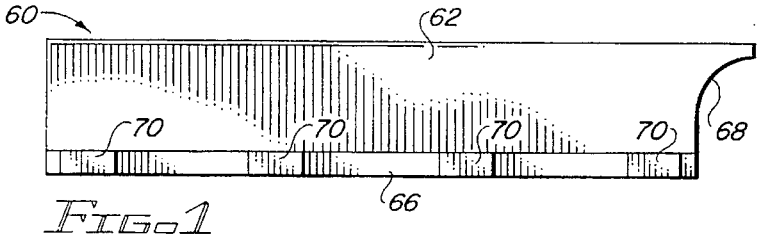
FIG. 1
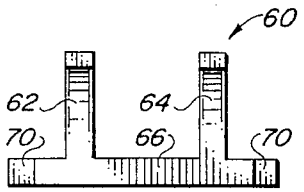
FIG. 3
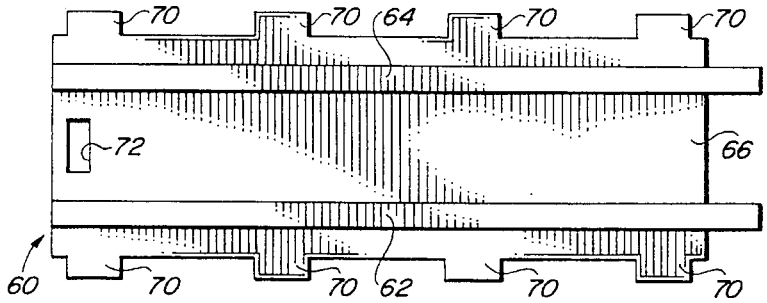
FIG. 2
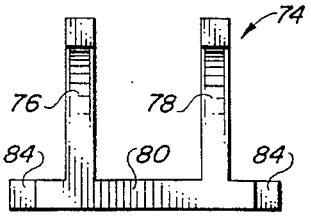
FIG. 6
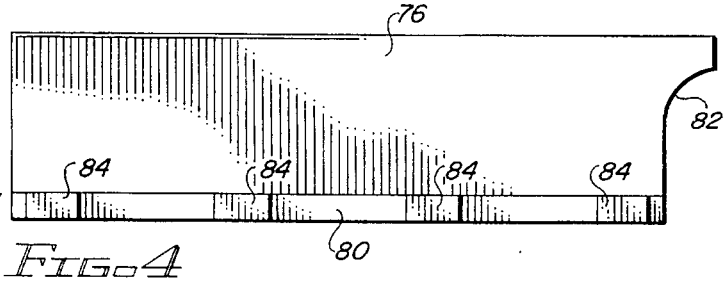
FIG. 4
FIG. 5
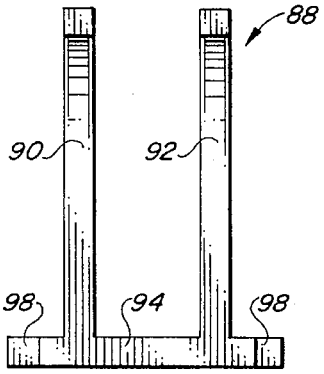
FIG. 9
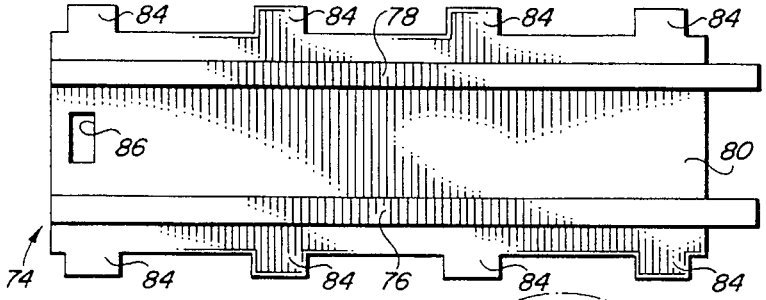
FIG. 24
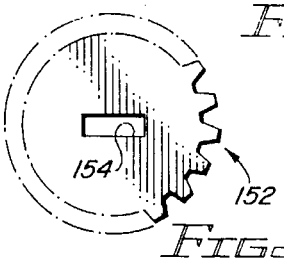
FIG. 22
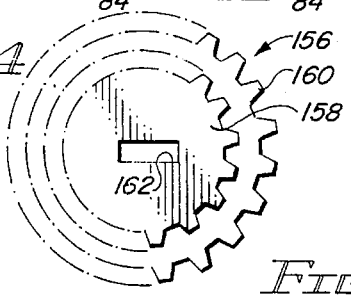
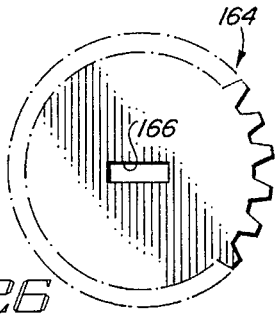
FIG. 26
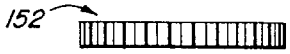
FIG. 23
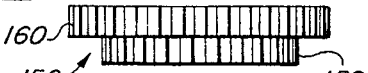
FIG. 25
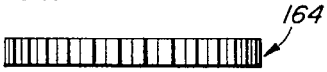
FIG. 27

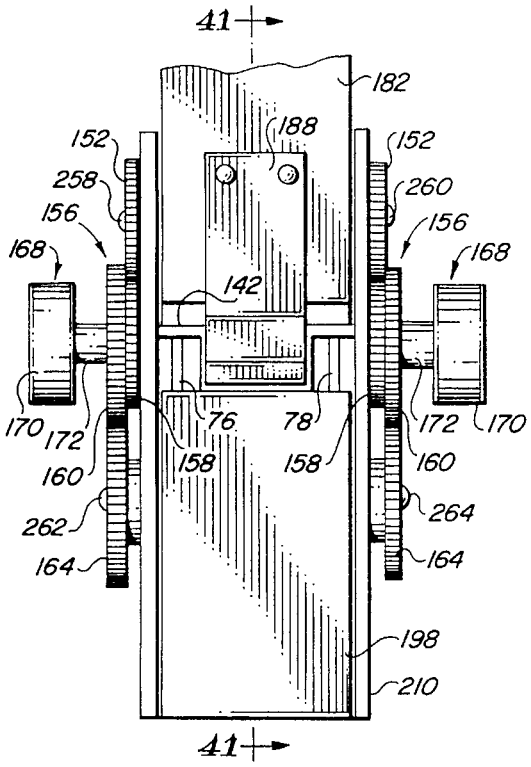
FIG. 39
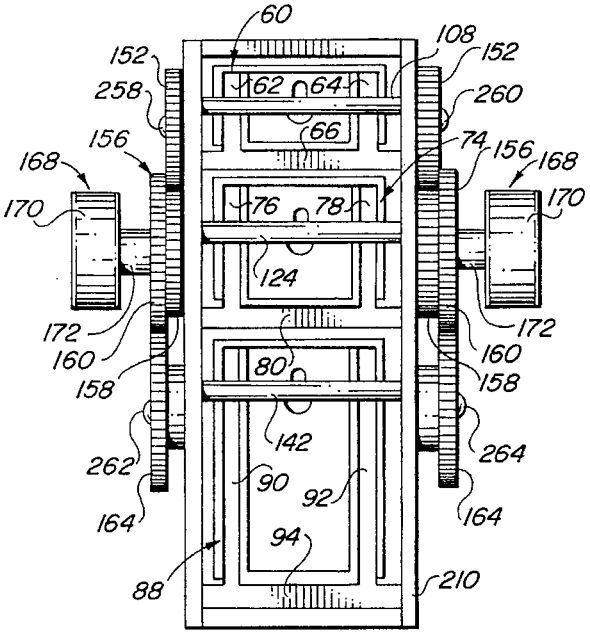
FIG. 40
FIG. 45
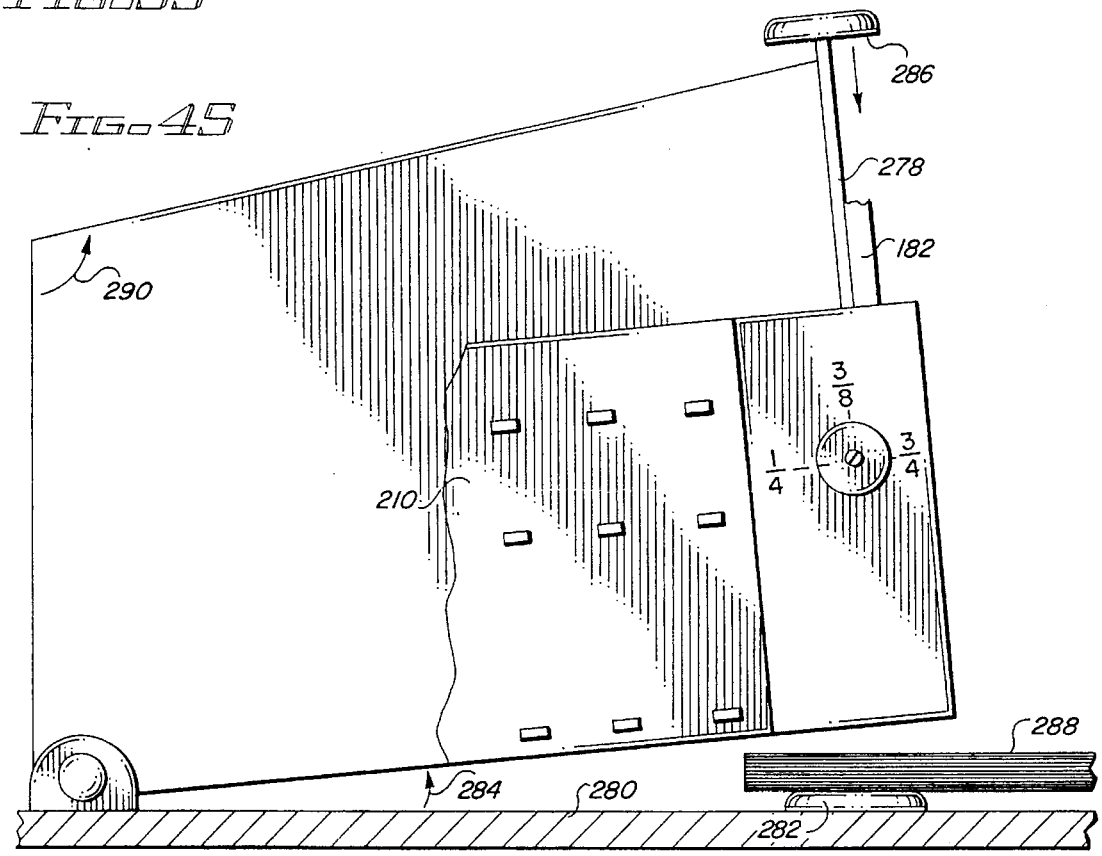

STAPLER APPARATUS AND METHOD FOR SELECTIVELY DISPENSING A PLURALITY OF DIFFERENT SIZE STAPLES

BACKGROUND OF THE INVENTION

1. Field of the Invention

The present invention relates generally to staplers which are used to bind documents, and more particularly to an improved stapler and related method of operating the improved stapler in which a selective one of a plurality of different size staples all stored within the stapler itself is selected for dispensing without necessitating the removal of any staples of a non-selected size from the stapler, or reloading the stapler with the selected size of staples.

One of the most common devices which is found in offices all over the world is the stapler. Staplers have been used for years to fasten a plurality of sheets of paper together using a thin, U-shaped piece of wire which is known as a staple. The base of the U is known as the crown of the staple, with the legs of the U forming the staple legs. A plurality of sheets of paper to be fastened together is placed on top of anvil having recesses disposed in the top side thereof, which recesses function as a clinching device.

A cassette designed to hold a plurality of staples therein is disposed with the plurality of staples biased toward an end of the cassette which is located over the anvil. The cassette supports the plurality of staples on the bottom side of the crowns of the staples, with a single staple extending into a slotted aperture located in the end of the cassette which is located over the anvil, with the slotted aperture being aligned with the recesses in the anvil. The staple extending into the slotted aperture in the end of the cassette is unsupported on the bottom side of its crown.

A driving member, which is typically a thin driving blade, extends into the slotted aperture from the top of the cassette, above the staple extending into the slotted aperture in the end of the cassette. The driving blade is driven into contact with the top side of the crown of the staple extending into the slotted aperture in the end of the cassette, driving the staple legs into and through the plurality of sheets of paper on the anvil, and then into contact with the recesses disposed in the top side of the anvil. When the staple legs extend into the recesses in the anvil, they are clinched, typically towards each other, to thereby retain the staple in the plurality of sheets of paper to keep the plurality of sheets of paper together.

The driving blade is driven by hand in simple desktop staplers, with a single swift impact from the user's hand being more than sufficient to drive the staple into the sheets of paper and to clinch it on the bottom of the paper. In a slightly more sophisticated desktop stapler, the impact is provided electromechanically, with the sheets of paper being inserted into place to electrically trigger operation of the driving blade. In heavy duty industrial applications, a stapler may even be operated using pneumatic pressure to operate the driving blade.

All of these devices have one thing in common—the use of a cassette containing a row of staples of a particular size. This leads to an observation which is both illustrative of the intrinsic operation of such staplers, and which is also an inherent disadvantage of such staplers. At any given time, they are designed to drive a staple of one particular size only, with that size staple being best applied to use to fasten together a specific range of numbers of sheets of paper.

For example, a short (one-quarter inch, for example) staple may be used to fasten from two to twenty-five sheets of paper together. If a greater number of sheets of paper are to be fastened together using a short staple, they will not be fastened together securely. Similarly, a long (three-quarter inch, for example) staple may be used to fasten from fifty to one hundred sheets of paper together. If a smaller number of sheets of paper are to be fastened together using a long staple, the staple legs will be over-clinched and may extend out in an unsafe manner, with the sheets of paper being held together relatively loosely.

As one might imagine, the art has addressed this problem in several ways, which can be divided into two types of staplers. The first type of stapler involves the modification of the cassette of the stapler so that it will accept staples of different lengths. The second type of stapler does not use staples of a fixed size, but instead makes staples from a continuous length of wire to fit the particular application.

An example of the first type of stapler is illustrated in U.S. Pat. No. 4,763,824, to Ebihara. The Ebihara reference discloses a stapler cassette which is capable of holding staples having a common width crown, but with different length staple legs. The Ebihara stapler is accordingly usable with staples of different lengths, but the staple supply in the cassette must be changed in order to change the length of staples which will be dispensed by the device. This is not particularly convenient, since the Ebihara device does not provide storage for staples other than the particular size staples loaded into the cassette.

Examples of the second type of stapler are illustrated in U.S. Pat. No. 4,318,555, to Adamski et al.; in U.S. Pat. No. 4,421,264, to Arter et al.; in U.S. Pat. No. 4,356,947, to Marshall, et al.; in U.S. Pat. No. 4,389,011, to Lovibond; and in U.S. Pat. No. 5,018,656, to Phelps. These devices all have two things in common—they use a continuous supply of wire from which variable lengths are cut to form staples having variable length staple legs, and they are all for use in copy machines. These staplers all solve the problem addressed by the present invention in that the handling and changing of different size staples is eliminated. However, these devices are all large, complex, and expensive, and they are not suitable for use in a desktop application.

It is accordingly the primary objective of the present invention that it provide a stapler which is capable of selectively dispensing a plurality of different staple sizes without requiring staples of different sizes to be unloaded from the stapler, or loaded into the stapler. It is also an objective of the present invention that it be capable of dispensing a wide range of different staple sizes, thereby eliminating the requirement that an office have multiple different staplers for different stapling applications. It is a related objective that a plurality of different size staples be storable in distinct locations in the stapler of the present invention, and that these distinct locations be independently accessible to allow the particular size of staples accommodated therein to be conveniently reloaded.

An additional objective is that the particular size of staples to be dispensed be selectable from among the plurality of sizes of staples stored in the stapler of the present invention in a simple and easy to accomplish manner. It is a further objective that the driving force used to operate the stapler of the present invention may alternately be the hand of a user, or an electromechanically driven mechanism. It is yet another objective of the stapler of the present invention that it be as compact as is possible, to thereby present a device which will have excellent application on a desktop where space is at a premium, or in other similar locations.

The stapler of the present invention must be of fabrication which is both durable and long lasting, and it should require little or no maintenance to be provided by its user throughout its operating lifetime. In order to enhance the market appeal of the stapler of the present invention, it should also be of inexpensive construction to thereby afford it the broadest possible market. Finally, it is also an objective that all of the aforesaid advantages and objectives of the stapler of the present invention be achieved without incurring any substantial relative disadvantage.

SUMMARY OF THE INVENTION

The disadvantages and limitations of the background art discussed above are overcome by the present invention. With this invention, a stapler for selectively dispensing staples of a plurality of different sizes is disclosed. The stapler of the present invention has a great deal in common with staplers well known in the art, but differs from such staplers in two primary respects.

First, the stapler of the present invention has a plurality of cassettes included therein in a unitary staple magazine construction, with each of the cassettes being adapted to contain staples of a different size. The cassettes are oriented in a vertical array, so that the crowns of rows of staples contained in adjacent cassettes form parallel planes located one atop the other. Each of the rows of different size staples may be independently refilled, and in the preferred embodiment each row of staples uses a conventional staple feeding mechanism to bias the staples toward the end from which they will be dispensed.

The second difference that the stapler of the present invention exhibits when compared to staplers of conventional construction is that it contains a selector mechanism for selectively, alternately choosing which one of the different size staples contained in different rows is to be dispensed. The selector mechanism operates in opposition to the staple feeding mechanism which biases the staples toward the end from which they are dispensed. The selector mechanism allows only one of the rows of different size staples to extend fully to the end of the stapler from which the staples are dispensed.

Thus, by operating the selector mechanism, different size staples contained in different rows are alternately, selectively either allowed to be fully advanced to the end of the stapler from which the staples are dispensed by the staple feeding mechanism, or are actively urged back away from the end of the stapler from which the staples are dispensed in opposition to the staple feeding mechanism. In any event, it is critical that the staple feeding mechanism allow only a single row of staples to be fully advanced to the end of the stapler from which the staples will be dispensed at a time.

The rest of the mechanism of the stapler of the present invention is essentially conventional. A driving blade is used to drive the end one of the selected row of staples from the magazine through a plurality of sheets of paper, and then into contact with an anvil having recesses located in the top surface thereof, which recesses cause clenching of the staple legs. Since the stapler of the present invention has a plurality of staple cassettes located one atop the other, the driving blade may necessarily be longer than in a stapler having only a single staple cassette. Additionally, the driving blade may also require a longer operating stroke.

With the exceptions noted above, the stapler of the present invention is essentially identical in operation to staplers known in the art. The driving blade may be operated either by hand, or by an electromechanical mechanism. The driving blade, like that in known staplers, is typically biased in an upward direction away from the anvil and above the level of the staples contained in the cassettes. The magazine may also be biased upwardly away from the anvil, as is also conventional.

It may therefore be seen that the present invention teaches a stapler which is capable of selectively dispensing a plurality of different staple sizes without requiring staples of different sizes to be unloaded from the stapler, or loaded into the stapler. The stapler of the present invention is also capable of dispensing a wide range of different staple sizes, thereby eliminating the requirement that an office have multiple different staplers for different stapling applications. In addition, a plurality of different size staples are storable in distinct locations in the stapler of the present invention, with each of these distinct locations being independently accessible to allow the particular size of staples accommodated therein to be conveniently reloaded.

The particular size of staples to be dispensed by the stapler of the present invention is selectable from among the plurality of sizes of staples stored therein in a simple and easy to accomplish manner. The driving force used to operate the stapler of the present invention may either be the hand of a user in a manual application, or an electromechanically driven mechanism in a power operated application. The stapler of the present invention is quite compact in view of the fact that it contains multiple different sizes of staples, thereby presenting a device which has application either on a desktop where space is at a premium, or in other similar locations.

The stapler of the present invention is of fabrication which is both durable and long lasting, and it requires little or no maintenance to be provided by its user throughout its operating lifetime. In order to enhance the market appeal of the stapler of the present invention, it is of inexpensive construction to thereby afford it the broadest possible market. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which:

FIG. 1 is a side plan view of a first staple guide member for supporting staples of a first size, particularly showing the configuration of the first staple guide member at the end illustrated on the right side thereof in FIG. 1;

FIG. 2 is a top plan view of the first staple guide member illustrated in FIG. 1, showing twin parallel support rails used to support staples of the first size thereon, and also showing an aperture to be used for securing a first staple feeding mechanism (not shown in FIG. 2);

FIG. 3 is an end view of the first staple guide member illustrated in FIGS. 1 and 2, also showing the twin parallel support rails thereof;

FIG. 4 is a side plan view of a second staple guide member for supporting staples of a second size, particularly showing the configuration of the second staple guide member at the end illustrated on the right side thereof in FIG. 4;

FIG. 5 is a top plan view of the second staple guide member illustrated in FIG. 4, showing twin parallel support rails used to support staples of the second size thereon, and also showing an aperture to be used for securing a second staple feeding mechanism (not shown in FIG. 5);

FIG. 6 is an end view of the second staple guide member illustrated in FIGS. 4 and 5, also showing the twin parallel support rails thereof;

FIG. 9 is an end view of the third staple guide member illustrated in FIGS. 7 and 8, also showing the twin parallel support rails thereof;

FIG. 22 is a plan view of a first gear member having a rectangular aperture located therein for placement onto one of the rectangular projections of the first camming element illustrated in FIGS. 10 through 13;

FIG. 23 is a side view of the first gear member illustrated in FIG. 22;

FIG. 24 is a plan view of a second gear member having a rectangular aperture located therein for placement over one of the rectangular projections of the second camming element illustrated in FIGS. 14 through 17;

FIG. 25 is a side view of the second gear member illustrated in FIG. 24;

FIG. 26 is a plan view of a third gear member having a rectangular aperture located therein for placement onto one of the rectangular projections of the third camming element illustrated in FIGS. 18 through 21;

FIG. 27 is a side view of the third gear member illustrated in FIG. 26;

FIG. 39 is an end view of the magazine housing and other components illustrated in FIGS. 37 and 38, with two of the first gear members illustrated in FIGS. 22 and 23, two of the second gear members illustrated in FIG. 24 and 25, two of the third gear members illustrated in FIG. 26 and 27, and two of the staple size selector knobs illustrated in FIGS. 28 and 29, all of which components are installed thereon;

FIG. 40 is an end view of the magazine housing and other components similar to the view illustrated in FIG. 39, but with the first driving blade guide member and the second driving blade guide member removed for clarity;

FIG. 45 is a view of the magazine housing and other components as illustrated in FIG. 39 with a cover mounted over the gears, and with the magazine housing pivotally mounted on a schematically illustrated base member having an anvil located thereon, and also showing the driving blade and a schematically illustrated actuator for operating the driving blade.

DETAILED DESCRIPTION OF THE PREFERRED EMBODIMENT

Figure 7:
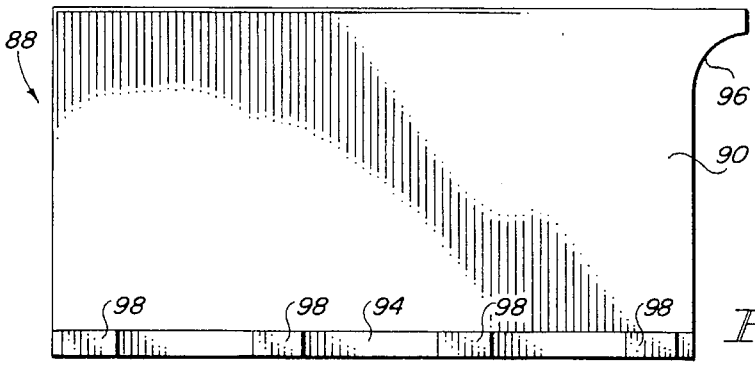
FIG. 7 is a side plan view of a third staple guide member for supporting staples of a third size, particularly showing the configuration of the third staple guide member at the end illustrated on the right side thereof in FIG. 7.

The preferred embodiment of the stapler of the present invention is illustrated by way of example herein, with the stapler being capable of containing and alternately, selectively dispensing three different staple sizes. As mentioned above, the stapler of the present invention differs from previously known staplers in two principal aspects. First, the stapler of the present invention has a magazine which includes multiple cassettes for holding staples of different sizes—three cassettes in the example illustrated herein. Second, the stapler of the present invention includes a selector mechanism for selecting which of the multiple staple sizes is to be driven. These two aspects will be shown in considerable detail, with other more conventional components and conventional aspects of the stapler of the present invention being shown in much less detail.

Referring first to FIGS. 1 through 3, a first staple guide member 60 is illustrated. The first staple guide member 60 includes two flat, parallel support rails 62 and 64 which extend upwardly from a base member 66. The support rails 62 and 64 are of a height which will support staples of a first size (such as, for example, one-quarter inch high staples) thereon. Note the configuration of the support rails 62 and 64 at the end illustrated on the right side thereof in FIG. 1.

The support rails 62 and 64 have a curved notch located at the right end and the bottom thereof, which curved notch is indicated generally by the reference numeral 68. The curved notch 68 will be used to provide clearance for the portion of the selector mechanism (not illustrated in FIGS. 1 through 3) which selectively will allow staples located on the first staple guide member 60 to extend from the right side of the support rails 62 and 64, or, alternately, will urge staples located on the first staple guide member 60 to the left away from the right side of the support rails 62 and 64.

Projecting outwardly from the sides of the base member 66 of the first staple guide member 60 are a plurality of rectangular projections 70, which will be used to facilitate mounting the first staple guide member 60 in a magazine housing (not illustrated in FIGS. 1 through 3). Centrally located in the base member 66 at the end of the first staple guide member 60 opposite the curved notch 68 is an aperture 72, which will be used be used to facilitate securing a first staple feeding mechanism (not illustrated in FIGS. 1 through 3).

Referring next to FIGS. 4 through 6, a second staple guide member 74 is illustrated. The second staple guide member 74 includes two flat, parallel support rails 76 and 78 which extend upwardly from a base member 80. The support rails 76 and 78 are of a height which will support staples of a second size (such as, for example, three-eighth inch high staples) thereon. Note the configuration of the support rails 76 and 78 at the end illustrated on the right side thereof in FIG. 1.

The support rails 76 and 78 have a curved notch located at the right end and the bottom thereof, which curved notch is indicated generally by the reference numeral 82. The curved notch 82 will be used to provide clearance for the portion of the selector mechanism (not illustrated in FIGS. 1 through 3) which selectively will allow staples located on the second staple guide member 74 to extend from the right side of the support rails 76 and 78, or, alternately, will urge staples located on the second staple guide member 74 to the left away from the right side of the support rails 76 and 78.

Projecting outwardly from the sides of the base member 80 of the second staple guide member 74 are a plurality of rectangular projections 84, which will be used to facilitate mounting the second staple guide member 74 in a magazine housing (not illustrated in FIGS. 4 through 6). Centrally located in the base member 80 at the end of the second staple guide member 74 opposite the curved notch 82 is an aperture 86, which will be used be used to facilitate securing a second staple feeding mechanism (not illustrated in FIGS. 4 through 6).

Figure 8:
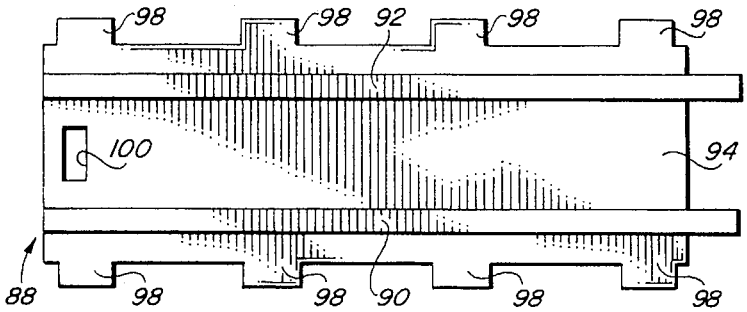
FIG. 8 is a top plan view of the third staple guide member illustrated in FIG. 7, showing twin parallel support rails used to support staples of the third size thereon, and also showing an aperture to be used for securing a third staple feeding mechanism (not shown in FIG. 8)

Referring now to FIGS. 7 through 9, a third staple guide member 88 is illustrated. The third staple guide member 88 includes two flat, parallel support rails 90 and 92 which extend upwardly from a base member 94. The support rails 90 and 92 are of a height which will support staples of a first size (such as, for example, three-quarter inch high staples) thereon. Note the configuration of the support rails 90 and 92 at the end illustrated on the right side thereof in FIG. 1.

The support rails 90 and 92 have a curved notch located at the right end and the bottom thereof, which curved notch is indicated generally by the reference numeral 96. The curved notch 96 will be used to provide clearance for the portion of the selector mechanism (not illustrated in FIGS. 1 through 3) which selectively will allow staples located on the third staple guide member 88 to extend from the right side of the support rails 90 and 92, or, alternately, will urge staples located on the third staple guide member 88 to the left away from the right side of the support rails 90 and 92.

Projecting outwardly from the sides of the base member 94 of the third staple guide member 88 are a plurality of rectangular projections 98, which will be used to facilitate mounting the third staple guide member 88 in a magazine housing (not illustrated in FIGS. 7 through 9). Centrally located in the base member 94 at the end of the third staple guide member 88 opposite the curved notch 96 is an aperture 100, which will be used be used to facilitate securing a third staple feeding mechanism (not illustrated in FIGS. 7 through 9).

Referring to FIGS. 10 through 13, a first camming element 102 is illustrated, which first camming element 102 is the part of the staple selector mechanism which will be used in conjunction with staples of the first size located on the first staple guide member 60 (FIGS. 1 through 3). The first camming element 102 includes a pair of spaced apart, relatively thin cylindrical members 104 and 106 having a single shaft 108 extending therebetween. The thicknesses of the cylindrical members 104 and 106 are identical.

Figures 10, 11, 12, 13:
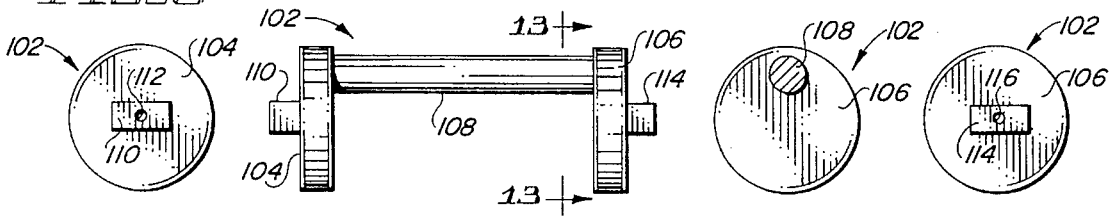
FIG. 10 is a side view of a first camming element which is the part of the staple selector mechanism to be used in conjunction with staples of the first size, showing a single shaft extending between two cylindrical members in eccentric fashion.
FIG. 11 is an end view of the first camming element illustrated in FIG. 10 from one end thereof, showing a rectangular projection extending from one of the cylindrical members of the first camming element.
FIG. 12 is an end view of the first camming element illustrated in FIGS. 10 and 11 from the other end thereof, showing a rectangular projection extending from the other of the cylindrical members of the first camming element.
FIG. 13 is a cross-sectional view of the first camming element illustrated in FIGS. 10 through 12, showing the cross-sectional configuration of the shaft extending between the two cylindrical members of the first camming element.

The shaft 108 is eccentrically located between the cylindrical members 104 and 106 so that rotation of the cylindrical members 104 and 106 will move the shaft 108 laterally back and forth. The shaft 108 is located slightly to one side of the central axis of the cylindrical members 104 and 106, as best shown in FIG. 13.

Centrally located on the side of the cylindrical member 104 opposite the side from which the shaft 108 extends is a rectangular projection 110. Centrally located in the rectangular projection 110 is a tapped aperture 112. Centrally located on the side of the cylindrical member 106 opposite the side from which the shaft 108 extends is a rectangular projection 114. Centrally located in the rectangular projection 114 is a tapped aperture 116. The heights of the rectangular projections 110 and 114 are equal.

Referring to FIGS. 14 through 17, a second camming element 118 is illustrated, which second camming element 118 is the part of the staple selector mechanism which will be used in conjunction with staples of the second size located on the second staple guide member 74 (FIGS. 4 through 6). The second camming element 118 includes a pair of spaced apart, relatively thin cylindrical members 120 and 122 having two spaced apart shafts 124 and 126 extending therebetween. The thicknesses of the cylindrical members 120 and 122 are identical, and are identical to the thicknesses of cylindrical members 104 and 106 in the first camming element 102 (FIG. 10).

Figures 14, 15, 16, 17:
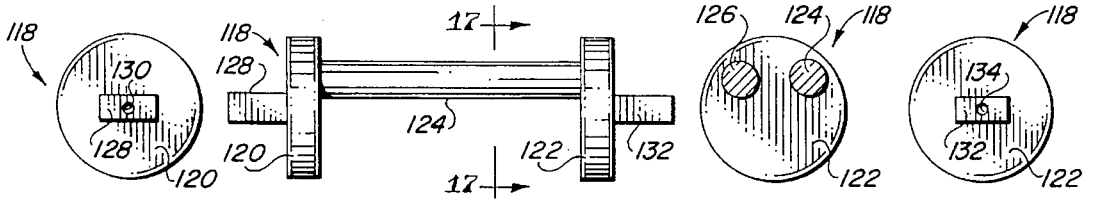
FIG. 14 is a side view of a second camming element which is the part of the staple selector mechanism to be used in conjunction with staples of the second size, showing one of two shafts extending between two cylindrical members in eccentric fashion.
FIG. 15 is an end view of the second camming element illustrated in FIG. 14 from one end thereof, showing a rectangular projection extending from one of the cylindrical members of the second camming element.
FIG. 16 is an end view of the second camming element illustrated in FIGS. 14 and 15 from the other end thereof, showing a rectangular projection extending from the other of the cylindrical members of the second camming element.
FIG. 17 is a cross-sectional view of the second camming element illustrated in FIGS. 14 through 16, showing the cross-sectional configuration of the two shafts extending between the two cylindrical members of the second camming element.

The shafts 124 and 126 are eccentrically located between the cylindrical members 120 and 122 so that rotation of the cylindrical members 120 and 122 will move the shafts 124 and 126 laterally back and forth. The shafts 124 and 126 are both located on the same halves of the cylindrical members 120 and 122 and slightly to one side of the central axis thereof, as best shown in FIG. 17. The lengths of the shafts 124 and 126 are identical to the length of the shaft 108 in the first camming element 102 (FIG. 10).

Centrally located on the side of the cylindrical member 120 opposite the side from which the shafts 124 and 126 extend is a rectangular projection 128. Centrally located in the rectangular projection 128 is a tapped aperture 130. Centrally located on the side of the cylindrical member 122 opposite the side from which the shafts 124 and 126 extend is a rectangular projection 132. Centrally located in the rectangular projection 132 is a tapped aperture 134. The heights of the rectangular projections 128 and 132 are equal, and are greater than the heights of the rectangular projections 110 and 114 of the first camming element 102 (FIG. 10).

Referring now to FIGS. 18 through 21, a third camming element 136 is illustrated, which third camming element 136 is the part of the staple selector mechanism which will be used in conjunction with staples of the third size located on the third staple guide member 88 (FIGS. 7 through 9). The third camming element 136 includes a pair of spaced apart, relatively thin cylindrical members 138 and 140 having a single shaft 142 extending therebetween. The thicknesses of the cylindrical members 138 and 140 are identical, and are greater than the thicknesses of the cylindrical members 104 and 106 in the first camming element 102 (FIG. 10), and the thicknesses of the cylindrical members 120 and 122 in the second camming element 118 (FIG. 14).

Figures 18, 19, 20, 21:
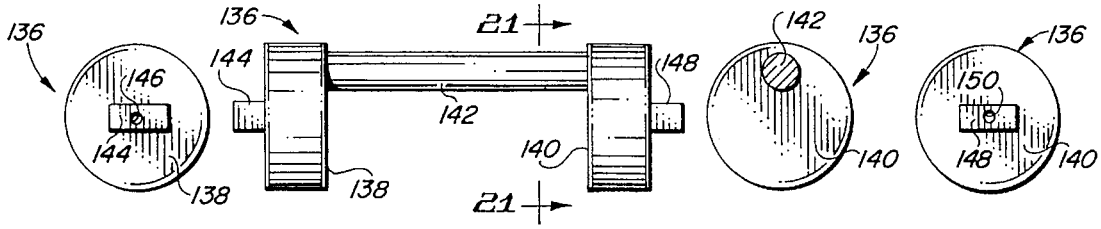
FIG. 18 is a side view of a third camming element which is the part of the staple selector mechanism to be used in conjunction with staples of the third size, showing a single shaft extending between two cylindrical members in eccentric fashion.
FIG. 19 is an end view of the third camming element illustrated in FIG. 18 from one end thereof, showing a rectangular projection extending from one of the cylindrical members of the third camming element.
FIG. 20 is an end view of the third camming element illustrated in FIGS. 18 and 19 from the other end thereof, showing a rectangular projection extending from the other of the cylindrical members of the third camming element.
FIG. 21 is a cross-sectional view of the third camming element illustrated in FIGS. 18 through 20, showing the cross-sectional configuration of the shaft extending between the two cylindrical members of the third camming element.

The shaft 142 is eccentrically located between the cylindrical members 138 and 140 so that rotation of the cylindrical members 138 and 140 will move the shaft laterally back and forth. The shaft 142 is located slightly to one side of the central axis of the cylindrical members 138 and 140, as best shown in FIG. 21. The length of the shaft 142 is identical to the length of the shaft 108 in the first camming element 102 (FIG. 10), and the lengths of the shafts 124 and 126 in the second camming element 118 (Figs. 14 and 17).

Centrally located on the side of the cylindrical member 138 opposite the side from which the shaft 142 extends is a rectangular projection 144. Centrally located in the rectangular projection 144 is a tapped aperture 146. Centrally located on the side of the cylindrical member 140 opposite the side from which the shaft 142 extends is a rectangular projection 148. Centrally located in the rectangular projection 148 is a tapped aperture 150. The heights of the rectangular projections 144 and 148 are equal, and are identical to the heights of the rectangular projections 110 and 114 of the first camming element 102 (FIG. 10). The heights of the rectangular projections 144 and 148 are less than the heights of the rectangular projections 128 and 132 of the second camming element 118 (FIG. 14).

Referring next to FIGS. 22 and 23, a first gear member 152 is illustrated. The first gear member 152 has a rectangular aperture 154 located therein, which rectangular aperture 154 is for placement onto one of the rectangular projections 110 or 114 of the first camming element 102 illustrated in FIGS. 10 through 13. The height of the rectangular projections 110 and 114 are equal to the thickness of the first gear member 152. Note that two of the first gear members 152 will be used in conjunction with the first camming element 102.

Referring now to FIGS. 24 and 25, a second gear member 156 is illustrated. The second gear member 156 includes a first gear element 158 and a second gear element 160, which are coaxial and adjacent each other. The first gear element 158 is of the same diameter and has the same pitch and number of gear teeth as the first gear member 152 (FIGS. 22 and 23). The first gear element 158 is smaller in diameter than the second gear element 160.

The second gear member 156 has a rectangular aperture 162 located therein, which rectangular aperture 162 is for placement onto one of the rectangular projections 128 or 132 of the second camming element 118 illustrated in FIGS. 14 through 17. The second gear member 156 will be mounted onto one of the rectangular projections 128 or 132 of the second camming element 118 with the first gear element 158 located adjacent one of the cylindrical members 120 and 122, respectively. The height of the rectangular projections 128 and 132 are greater than the thickness of the second gear member 156. Note that two of the second gear members 156 will be used in conjunction with the second camming element 118.

Referring next to FIGS. 26 and 27, a third gear member 164 is illustrated. The third gear member 164 is of the same diameter and has the same pitch and number of gear teeth as the second gear element 160 of the second gear member 156 (FIGS. 24 and 25). The third gear member 164 has a rectangular aperture 166 located therein, which rectangular aperture 166 is for placement onto one of the rectangular projections 144 or 148 of the third camming element 136 illustrated in FIGS. 18 through 21. The height of the rectangular projections 144 and 148 are equal to the thickness of the third gear member 164. Note that two of the third gear members 164 will be used in conjunction with the third camming element 136.

Figure 29:
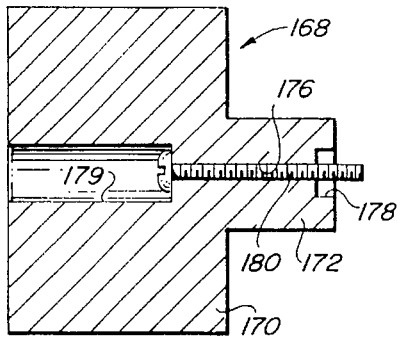
FIG. 29 is a side view of the staple size selector knob illustrated in FIG. 28, showing a bolt located in an aperture extending therethrough for use in mounting the staple size selector knob onto the second camming element illustrated in FIGS. 14 through 17.
Figure 28:
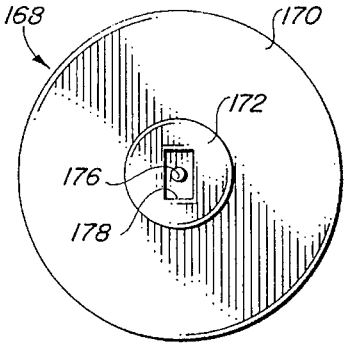
FIG. 28 is an end view of a staple size selector knob showing a rectangular aperture located therein for placement onto the distal end of one of the rectangular projections of the second camming element illustrated in FIGS. 14 through 17 after installation of the second gear member illustrated in FIGS. 24 and 25 thereon.

Referring to FIGS. 28 and 29, a staple size selector knob 168 is illustrated which has a greater diameter cylindrical portion 170 and a smaller diameter cylindrical portion 172. The greater diameter cylindrical portion 170 of the staple size selector knob 168 has a cylindrical recess 174 located axially therein, with a smaller diameter aperture 176 extending through the rest of the greater diameter cylindrical portion 170 of the staple size selector knob 168 and the entire smaller diameter cylindrical portion 172 of the staple size selector knob 168.

Located in the smaller diameter cylindrical portion 172 of the staple size selector knob 168 around the aperture 176 is a rectangular aperture 178. The rectangular aperture 178 is for placement onto the distal end of one of the rectangular projections 144 and 148 of the second camming element 118 (FIGS. 14 through 17) after installation of the second gear member 156 (FIGS. 24 and 25) onto one of the rectangular projections 144 and 148. Also shown in FIG. 29 is a screw 180 for installation through the cylindrical recess 174 into the aperture 176 in the staple size selector knob 168 to retain the staple size selector knob 168 on the second camming element 118.

Referring now to FIGS. 30 through 33, a first driving blade guide member 182 is illustrated (note that the first driving blade guide member extends further upward from the portion illustrated in the figures). The first driving blade guide member 182 has an inner side, best shown in FIG. 31, which will face a driving blade (not shown in FIGS. 30 through 33). Horizontally located in the first driving blade guide member 182 on the inner side thereof is a laterally extending notch 184, which will function to limit rotation of the first camming element 102 (FIGS. 10 through 13). Located on the bottom of the first driving blade guide member 182 and facing the inner side of the first driving blade guide member 182 is a laterally extending beveled edge 186.

Mounted onto the outer side of the first driving blade guide member 182 (best illustrated in FIG. 30) is a spring member 188, which extends below the laterally extending beveled edge 186 of the first driving blade guide member 182. The spring member 188 will serve a dual function: first, to act as a blade guide when staples of either the first size or the third size are to be dispensed, and second, to inhibit rotation of the second camming element 118 (FIGS. 14 through 17) when staples of the second size are to be dispensed. Completing the construction of the first driving blade guide member 182 are two threaded apertures 190 and 192 located in one side thereof, and two threaded apertures 194 and 196 located in the other side thereof.

Figures 34, 36:
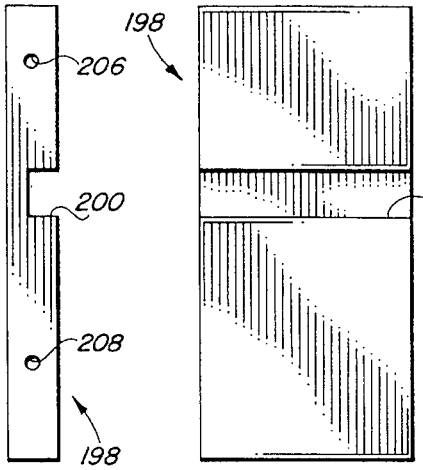
FIG. 34 is a plan view of the inner side of a second driving blade guide member, showing a notch located therein.
FIG. 36 is a side view of the second driving blade guide member illustrated in FIGS. 34 and 35 from the other side thereof, showing a pair of threaded apertures located in the other side thereof.
Figure 35:
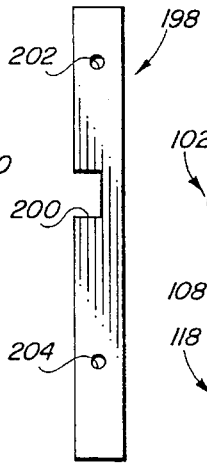
FIG. 35 is a side view of the second driving blade guide member illustrated in FIG. 34 from one side thereof, showing a pair of threaded apertures located in the one side thereof.

Referring next to FIGS. 34 through 36, a second driving blade guide member 198 is illustrated. The second driving blade guide member 198 has an inner side, best shown in FIG. 34, which will face a driving blade (not shown in FIGS. 34 through 36). Horizontally located in the second driving blade guide member 198 on the inner side thereof is a laterally extending notch 200, which will function to limit rotation of the third camming element 136 (FIGS. 18 through 21). Completing the construction of the second driving blade guide member 198 are two threaded apertures 202 and 204 located in one side thereof, and two threaded apertures 206 and 208 located in the other side thereof.

Figure 37:
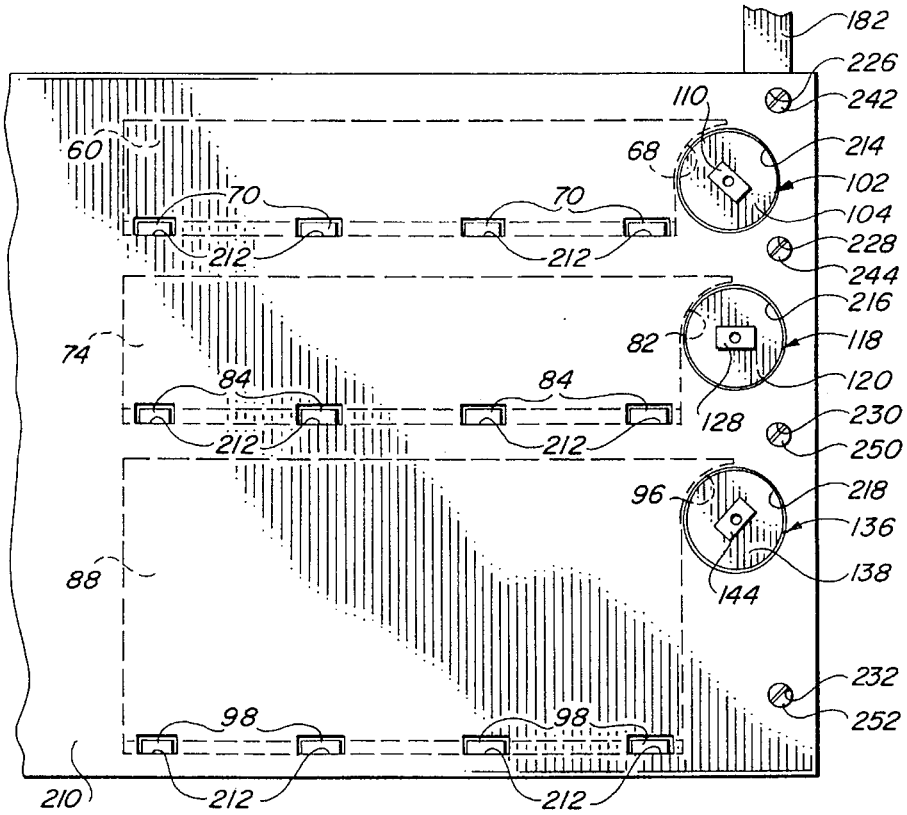
FIG. 37 is a side view of a magazine housing from one side thereof, the magazine housing containing the first staple guide member illustrated in FIGS. 1 through 3, the second staple guide member illustrated in FIGS. 4 through 6, the third staple guide member illustrated in FIGS. 7 through 9, the first camming element illustrated in FIGS. 10 through 13, the second camming element illustrated in FIGS. 14 through 17, the third camming element illustrated in FIGS. 18 through 21, the first driving blade guide member illustrated in FIGS. 30 through 33, and the second driving blade guide member illustrated in FIGS. 34 through 36, all of which components are installed in the magazine housing.
Figure 38:
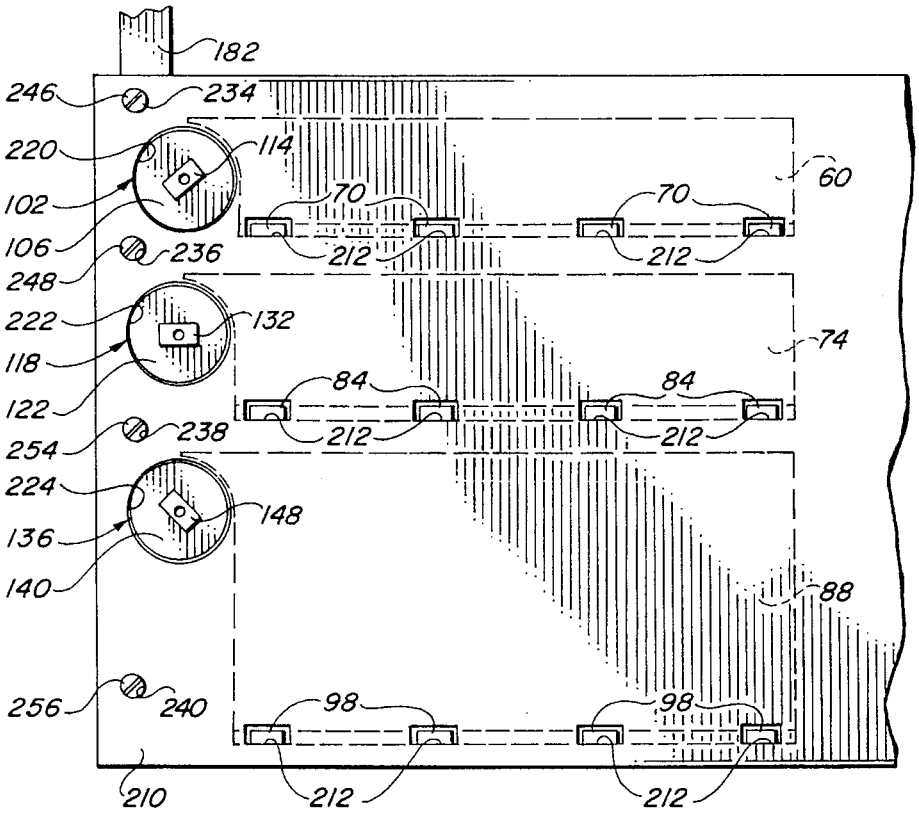
FIG. 38 is a side view of the magazine housing and other components illustrated in FIG. 37 from the other side of the magazine housing.

Referring next to FIGS. 37 and 38, the installation of a number of the components described above into a magazine housing 210 is illustrated. The magazine housing 210 is essentially U-shaped in cross-section, with the U being inverted with the open side being on the bottom in the views depicted in FIGS. 37 and 38. The first staple guide member 60 illustrated in FIGS. 1 through 3, the second staple guide member 74 illustrated in FIGS. 4 through 6, and the third staple guide member 88 illustrated in FIGS. 7 through 9 (all shown in dotted lines) are installed into the magazine housing 210.

The installation of the staple guide members 60, 74, and 88 is facilitated by a plurality of rectangular apertures 212 located in the sides of the magazine housing 210. The rectangular projections 70, 84, and 98 in the staple guide members 60, 74, and 88, respectively, fit into the rectangular apertures 212 in the magazine housing 210 to retain the staple guide members 60, 74, and 88, respectively, in place within the magazine housing 210. Thus, it will be appreciated by those skilled in the art that the staple guide members 60, 74, and 88 are oriented in a vertical array, atop each other.

The first camming element 102 illustrated in FIGS. 10 through 13, the second camming element 118 illustrated in FIGS. 14 through 17, and the third camming element 136 illustrated in FIGS. 18 through 21 are rotatably mounted in the magazine housing 210. The side of the magazine housing 210 illustrated in FIG. 37 contains three circular apertures 214, 216, and 218 therein. The side of the magazine housing 210 illustrated in FIG. 38 contains three circular apertures 220, 222, and 224 therein. The circular apertures 214 and 220 are disposed adjacent the curved notch 68 (FIG. 1) in the first staple guide member 60, the circular apertures 216 and 222 are disposed adjacent the curved notch 82 (FIG. 4) in the second staple guide member 74, and the circular apertures 218 and 224 are disposed adjacent the curved notch 96 (FIG. 7) in the third staple guide member 88.

The first camming element 102 illustrated in FIGS. 10 through 13 is installed with the cylindrical member 104 being rotatably mounted in the circular aperture 214, and with the cylindrical member 106 being rotatably mounted in the circular aperture 220. The second camming element 118 illustrated in FIGS. 14 through 17 is installed with the cylindrical member 120 being rotatably mounted in the circular aperture 216, and with the cylindrical member 122 being rotatably mounted in the circular aperture 222. The third camming element 136 illustrated in FIGS. 18 through 21 is installed with the cylindrical member 138 being rotatably mounted in the circular aperture 218, and with the cylindrical member 140 being rotatably mounted in the circular aperture 224.

Also mounted in the magazine housing 210 are the first driving blade guide member 182 (FIGS. 30 through 33) and the second driving blade guide member 198 (FIGS. 34 through 36). The right side of the magazine housing 210 as illustrated in FIG. 37 contains four countersunk apertures 226, 228, 230, and 232 located therein. The left side of the magazine housing 210 as illustrated in FIG. 38 contains four countersunk apertures 234, 236, 238, and 240 located therein.

Referring now to FIG. 39 in addition to FIGS. 37 and 38, the first driving blade guide member 182 (FIGS. 30 through 33) is retained in the magazine housing 210 by flathead bolts 242, 244, 246, and 248, which are inserted through the countersunk apertures 226, 228, 234, and 236, respectively, in the magazine housing 210, and then are screwed into the threaded apertures 190, 192, 194, and 196 (FIGS. 32 and 33), respectively, in the first driving blade guide member 182. The second driving blade guide member 198 (FIGS. 34 through 36) is retained in the magazine housing 210 by flathead bolts 250, 252, 254, and 256, which are inserted through the countersunk apertures 230, 232, 238, and 240, respectively, in the magazine housing 210, and then are screwed into the threaded apertures 202, 204, 206, and 208 (FIGS. 35 and 36), respectively, in the second driving blade guide member 198.

Referring to FIGS. 39 and 40 in addition to FIGS. 27 and 38, the installation of the first gear members 152 (FIGS. 22 and 23), the second gear members 156 (FIGS. 24 and 25), the third gear members 164 (FIGS. 26 and 27), and the staple size selector knob 168 (FIGS. 28 and 29) is illustrated. The rectangular aperture 154 in one of the first gear members 152 is placed over the rectangular projection 110 on the first camming element 102, with a bolt 258 being screwed into the tapped aperture 112 (FIG. 11) to retain the one first gear member 152 in place adjacent the cylindrical member 104. The rectangular aperture 154 in another of the first gear members 152 is placed over the rectangular projection 114 on the first camming element 102, with a bolt 260 being screwed into the tapped aperture 116 (FIG. 12) to retain the other first gear member 152 in place adjacent the cylindrical member 106.

The rectangular aperture 162 in one of the second gear members 156 is placed over the rectangular projection 128 on the second camming element 118, with the first gear element 158 being located adjacent the cylindrical member 120. The rectangular projection 128 extends from the rectangular aperture 162 in the one second gear member 156. The first gear element 158 of the second gear member 156 adjacent the cylindrical member 120 engages the first gear member 152 adjacent the cylindrical member 104. The rectangular aperture 178 (FIG. 28) of one of the staple size selector knobs 168 is then placed over the rectangular projection 128 on the second camming element 118, and the bolt 180 (FIG. 29) is screwed into the tapped aperture 130 (FIG. 15) to retain both the one staple size selector knob 168 and the one second gear member 156 in place.

The rectangular aperture 162 in the other of the second gear members 156 is placed over the rectangular projection 132 on the second camming element 118, with the first gear element 158 being located adjacent the cylindrical member 122. The rectangular projection 132 extends from the rectangular aperture 162 in the other second gear member 156. The first gear element 158 of the second gear member 156 adjacent the cylindrical member 122 engages the first gear member 152 adjacent the cylindrical member 106. The rectangular aperture 178 (FIG. 28) of the other of the staple size selector knobs 168 is then placed over the rectangular projection 132 on the second camming element 118, and the bolt 180 (FIG. 29) is screwed into the tapped aperture 134 (FIG. 16) to retain both the other staple size selector knob 168 and the other second gear member 156 in place.

The rectangular aperture 166 in one of the third gear members 164 is placed over the rectangular projection 144 on the third camming element 136. The second gear element 160 of the second gear member 156 adjacent the cylindrical member 120 engages the third gear member 164 adjacent the cylindrical member 138. A bolt 262 is screwed into the tapped aperture 146 (FIG. 19) to retain the one third gear member 164 in place adjacent the cylindrical member 138.

The rectangular aperture 166 in the other of the third gear members 164 is placed over the rectangular projection 148 on the third camming element 136. The second gear element 160 of the second gear member 156 adjacent the cylindrical member 122 engages the third gear member 164 adjacent the cylindrical member 140. A bolt 264 is screwed into the tapped aperture 150 (FIG. 20) to retain the other third gear member 164 in place adjacent the cylindrical member 140.

Accordingly, it will be appreciated by those skilled in the art that the camming elements 102, 118, and 136 will rotate together. When one of the staple size selector knobs 168 is used to rotate the second camming element 118 a specific angular amount in a first direction, both the first camming element 102 and the third camming element 136 will rotate the same angular amount, but in the opposite direction.

Figure 41:
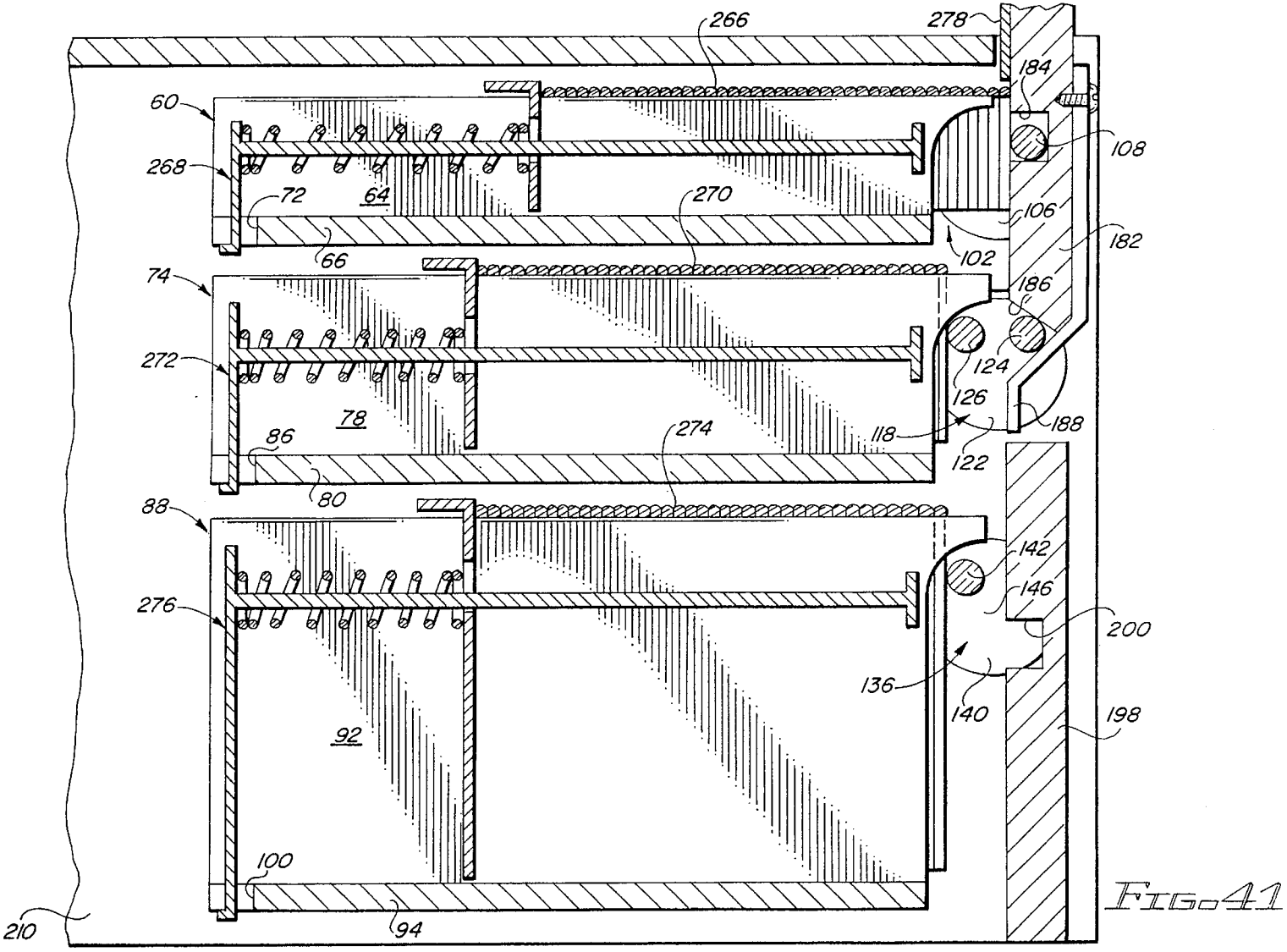
FIG. 41 is a cross-sectional view of the magazine housing as illustrated in FIG. 39 along line 41—41, showing staples of a first size installed in a first cassette formed by the magazine housing and the first staple guide member, staples of a second size installed in a second cassette formed by the magazine housing, the second staple guide member, and the bottom of the first staple guide member, and staples of a third size installed in a third cassette formed by the magazine housing, the third staple guide member, and the bottom of the second staple guide member, and also showing a first staple feeding mechanism, a second staple feeding mechanism, and a third staple feeding mechanism, and also showing the bottom portion of a driving blade.

Referring next to FIG. 41, a cross-sectional view of the assembly illustrated in FIG. 39 is illustrated. It will be appreciated from FIG. 41 that the rotation of the first camming element 102 is a clockwise direction (as seen in FIG. 41) is limited by contact by the shaft 108 of the first camming element 102 with the laterally extending notch 184 in the first driving blade guide member 182 to the position illustrated in FIG. 41. However, the first camming element 102 is free to rotate 180 degrees in a counterclockwise direction from the position illustrated in FIG. 41.

Similarly, it will be appreciated that the rotation of the third camming element 136 in a counterclockwise direction (as seen in FIG. 41) is limited by contact by the shaft 142 of the third camming element 136 with the laterally extending notch 200 in the second driving blade guide member 198 to a position 180 degrees clockwise from the position illustrated in FIG. 41. However, the third camming element 136 is also free to rotate 180 degrees in a counterclockwise direction from the position illustrated in FIG. 41.

Finally, it will be appreciated that the second camming element 118 is also free to rotate 180 degrees from the position illustrated in FIG. 41, but in a clockwise direction. Additionally, when the second camming element 118 rotates 90 degrees clockwise from the position illustrated in FIG. 41, further rotation in either direction will be inhibited, but not prevented, by contact of the bend in the spring member 188 with the shafts 142 and 144 of the second camming element 118.

A series of staples of a first size 266 is illustrated as stored in the first staple guide member 60. The series of staples of the first size 266 is urged to the right as illustrated in FIG. 41 by a first spring biased staple feeding mechanism 268, which is of conventional design, and which is retained in the aperture 72 in the first staple guide member 60. Note that the first camming element 102 allows the series of staples of the first size 266 to extend to the right adjacent the first driving blade guide member 182, with one staple of the series of staples of the first size 266 being over the right edge of the first staple guide member 60.

A series of staples of a second size 270 is illustrated as stored in the second staple guide member 74. The series of staples of the second size 270 is urged to the right as illustrated in FIG. 41 by a second spring biased staple feeding mechanism 272, which is also of conventional design, and which is retained in the aperture 86 in the second staple guide member 74. Note that the second camming element 118 urges the series of staples of the second size 270 to the left away from the first driving blade guide member 182 and the second driving blade guide member 198, with no staple of the series of staples of the second size 270 being over (or even near) the right edge of the second staple guide member 74.

A series of staples of a third size 274 is illustrated as stored in the third staple guide member 88. The series of staples of the third size 274 is urged to the right as illustrated in FIG. 41 by a third spring biased staple feeding mechanism 276, which is also of conventional design, and which is retained in the aperture 100 in the third staple guide member 88. Note that the third camming element 136 urges the series of staples of the third size 274 to the left away from the second driving blade guide member 198, with no staple of the series of staples of the third size 274 being over (or even near) the right edge of the third staple guide member 88.

Note also in FIG. 41 the presence of the lower portion of a driving blade 278. The driving blade 278 will travel from the position illustrated in FIG. 41 in a downward direction adjacent the first driving blade guide member 182 and the second driving blade guide member 198, until the bottom edge of the driving blade 278 reaches the bottom of the second driving blade guide member 198 and the magazine housing 210. In this travel, any staple located in a passageway adjacent the first driving blade guide member 182 and/or the second driving blade guide member 198 will be driven from the device. Thus, in the position illustrated in FIG. 41, the right-most staple in the series of staples of the first size 266 will be driven.

Figure 42:
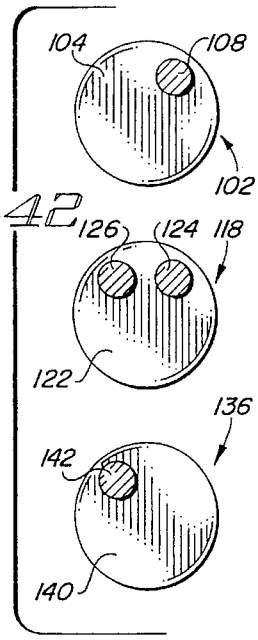
FIG. 42 is a side schematic view of the relative positions of the shafts of the first, second and third camming elements corresponding to the view illustrated in FIG. 41 when staples of the first size are to be dispensed.
Figure 43:
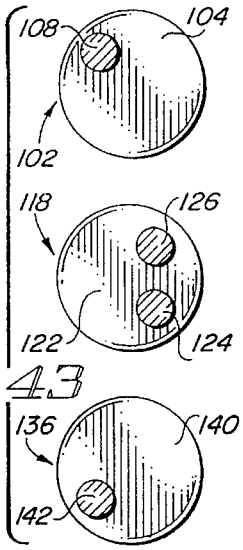
FIG. 43 is a side schematic view of the relative positions of the shafts of the first, second and third camming elements corresponding to the view illustrated in FIG. 41, but in relative positions whereby staples of the second size are to be dispensed.
Figure 44:
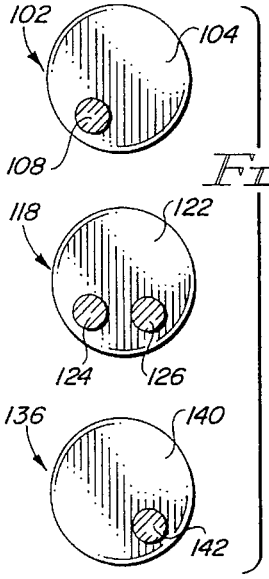
FIG. 44 is a side schematic view of the relative positions of the shafts of the first, second and third camming elements corresponding to the view illustrated in FIG. 41, but in relative positions whereby staples of the third size are to be dispensed.
Figure 32:
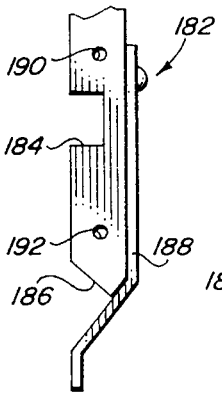
FIG. 32 is a side view of the first driving blade guide member illustrated in FIGS. 30 and 31 from one side thereof, showing a pair of threaded apertures located in the one side thereof.
Figure 30:
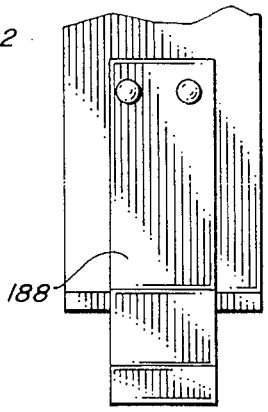
FIG. 30 is a plan view of the outer side of a first driving blade guide member, showing a spring member mounted thereon.
Figure 33:
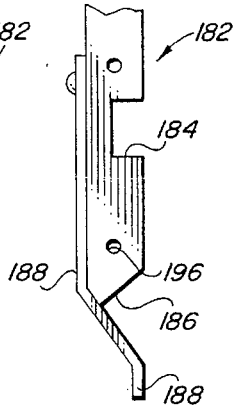
FIG. 33 is a side view of the first driving blade guide member illustrated in FIGS. 30 through 32 from the other side thereof, showing a pair of threaded apertures located in the other side thereof.
Figure 31:
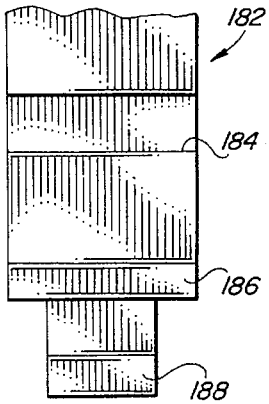
FIG. 31 is a plan view of the inner side of the first driving blade guide member illustrated in FIG. 30, showing a notch located therein.

Referring now to FIGS. 42 through 44 in addition to FIG. 41, the three relative positions of the camming elements 102, 118, and 136 are illustrated. The position illustrated in FIG. 42 is the same as the-one illustrated in FIG. 41, in which the series of staples of the first size 266 are located to the right adjacent the first driving blade guide member 182. In this position, the right-most one of the series of staples of the first size 266 will be driven, while the series of staples of the second size 270 and the series of staples of the third size 274 are located to the left and will not be driven.

In the position illustrated in FIG. 43, the series of staples of the second size 270 will be located to the right adjacent the first driving blade guide member 182 and the second driving blade guide member 198. In this position, the right-most one of the series of staples of the second size 270 will be driven, while the series of staples of the first size 266 and the series of staples of the third size 274 will be located to the left and will not be driven.

Finally, in the position illustrated in FIG. 44, the series of staples of the third size 274 will be located to the right adjacent the second driving blade guide member 198. In this position, the right-most one of the series of staples of the third size 274 will be driven, while the series of staples of the first size 266 and the series of staples of the second size 270 will be located to the left and will not be driven.

Referring now to FIG. 45, the conventional components of the stapler of the present invention are illustrated in schematic form. Note that a cover may be disposed to conceal a number of the various components mounted on the magazine housing 210. The left side of the magazine housing 210 as illustrated in FIG. 45 is pivotally mounted to a base 280 at the left side of the base. Located near the right side of the base 280 is an anvil 282 having recesses therein to cause clinching of staples urged into the anvil 282. In the preferred embodiment, a biasing member 284 urges the magazine housing 210 pivotally away from the base 280.

A driving element 286 is used to drive the driving blade 278 in a downward direction to cause the device to staple a stack of paper 288. The driving element 286 may be either a flat member which may be driven by the hand of a user, or, alternately, it may be an electromechanical driving mechanism. Both such mechanisms are conventional in the art. In the preferred embodiment, a biasing member 290 urges the driving element 286 upwardly to bias the driving blade 278 to a position above the uppermost of the staples contained in the magazine housing 210 when the driving element 286 is not actuated.

It may therefore be appreciated from the above detailed description of the preferred embodiment of the present invention that it teaches a stapler which is capable of selectively dispensing a plurality of different staple sizes without requiring staples of different sizes to be unloaded from the stapler, or loaded into the stapler. The stapler of the present invention is also capable of dispensing a wide range of different staple sizes, thereby eliminating the requirement that an office have multiple different staplers for different stapling applications. In addition, a plurality of different size staples are storable in distinct locations in the stapler of the present invention, with each of these distinct locations being independently accessible to allow the particular size of staples accommodated therein to be conveniently reloaded.

The particular size of staples to be dispensed by the stapler of the present invention is selectable from among the plurality of sizes of staples stored therein in a simple and easy to accomplish manner. The driving force used to operate the stapler of the present invention may either be the hand of a user in a manual application, or an electromechanically driven mechanism in a power operated application. The stapler of the present invention is quite compact in view of the fact that it contains multiple different sizes of staples, thereby presenting a device which has application either on a desktop where space is at a premium, or in other similar locations.

The stapler of the present invention is of fabrication which is both durable and long lasting, and it requires little or no maintenance to be provided by its user throughout its operating lifetime. In order to enhance the market appeal of the stapler of the present invention, it is of inexpensive construction to thereby afford it the broadest possible market. Finally, all of the aforesaid advantages and objectives of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A stapler for use in binding a plurality of sheets of paper together, said stapler comprising:

a housing member having a first end and a second end and a top and a bottom, said second end of said housing member defining a pathway extending between said top of said housing member and said bottom of said housing member through which pathway staples may be dispensed;

cassette means, disposed within said housing member, for storing a plurality of different size staples within said housing member, each of said plurality of sizes of staples being stored in one of a plurality of rows, said plurality of rows being arranged in a stacked array intermediate said top of said housing member and said bottom of said housing member;

means for biasing staples disposed in each of said plurality of rows in a direction from said first end of said housing member toward said second end of said housing member;

selector means for alternately, selectively displacing staples disposed in all but one of said plurality of rows back away from said second end of said housing member toward said first end of said housing member; and means for dispensing a staple disposed in said one of said plurality of rows which is not displaced back away from said second end of said housing member by urging the staple from said one of said plurality of rows through said pathway toward said first end of said housing member to bind a plurality of sheets of paper together.

2. A stapler as defined in claim 1, wherein said selector means comprises:

means for allowing a staple disposed in said one of said plurality of rows which is not displaced back away from said second end of said housing member toward said first end of said housing member to extend within said pathway, whereby no staple located in any of said all but said one of said plurality of rows is disposed within said pathway.

3. A stapler as defined in claim 1, wherein said pathway defined in said second end of said housing member has a cross-section of a size which will allow only one staple at a time to pass therethrough, and wherein said means for dispensing comprises:

a driving blade extending from said top of said housing member into said pathway, said driving blade having a bottom edge which is moveable between a first position and a second position, said driving blade being operable to dispense a staple when said driving blade moves from said first position to said second position.

4. A stapler as defined in claim 3, wherein said dispensing means additionally comprises:

a flat member which may be actuated by the hand of a user to cause said driving blade to be driven from said first position to said second position.

5. A stapler as defined in claim 3, wherein said dispensing means additionally comprises:

means for biasing said driving blade from said second position to said first position.

6. A stapler as defined in claim 1, additionally comprising:

an anvil member having a top surface, said top surface of said anvil member being disposed below the portion of said pathway at said bottom and said second end of said housing member, whereby sheets of paper may be placed intermediate said bottom of said housing member at said second end thereof and said anvil member.

7. A stapler as defined in claim 6, additionally comprising:

means for biasing said bottom of said housing member at said second end thereof upwardly away from said top surface of said anvil member.

8. A stapler as defined in claim 1, wherein said means for biasing staples comprises:

a spring biased staple feeding mechanism disposed in each of said plurality of rows.

9. A stapler as defined in claim 1, wherein said plurality of rows comprises:

a first row; and a second row, and wherein said stapler may thereby be utilized to dispense two different sizes of staples therefrom.

10. A stapler as defined in claim 9, wherein said selector means comprises:

a first displacing element for selectively displacing staples disposed in said first row back away from said second end of said housing member toward said first end of said housing member; and a second displacing element for selectively displacing staples disposed in said second row back away from said second end of said housing member toward said first end of said housing member.

11. A stapler as defined in claim 10, wherein said first and second displacing elements are mechanically interconnected to operate together, and wherein said selector means is operable to cause only one of said first and second displacing elements to operate to displace staples at a time.

12. A stapler as defined in claim 10, wherein each of said first and second displacing elements comprises:

an eccentric member which rotates about an axis between a first position and a second position.

13. A stapler as defined in claim 12, additionally comprising:

means for limiting the movement of said eccentric members between said first and second positions thereof.

14. A stapler as defined in claim 10, wherein said plurality of rows additionally comprises:

a third row, wherein said stapler may thereby be utilized to dispense three different sizes of staples therefrom;

and wherein said selector means additionally comprises:

a third displacing element for selectively displacing staples disposed in said third row back away from said second end of said housing member toward said first end of said housing member.

15. A stapler as defined in claim 14, wherein said first, second, and third displacing elements are mechanically interconnected to operate together, and wherein said selector means is operable to cause two of said first, second, and third displacing elements to operate to displace staples at a time.

16. A stapler as defined in claim 14, wherein each of said first, second, and third displacing elements comprises:

an eccentric member which rotates about an axis among a first position, a second position, and a third position, said second position being located intermediate said first and third positions.

17. A stapler as defined in claim 16, additionally comprising:

means for limiting the movement of said eccentric members between said first and third positions thereof.

18. A stapler for use in binding a plurality of sheets of paper together, said stapler comprising:

a housing member having a first end and a second end and a top and a bottom, said second end of said housing member defining a pathway extending between said top of said housing member and said bottom of said housing member through which pathway staples may be dispensed, wherein said pathway defined in said second end of said housing member is relatively wide and thin in cross-section;

cassette means, disposed within said housing member, for storing a plurality of different size staples within said housing member, each of said plurality of sizes of staples being stored in one of a plurality of rows, said plurality of rows being arranged in a stacked array intermediate said top of said housing member and said bottom of said housing member;

a spring biased staple feeding mechanism disposed in each of said plurality of rows, said spring biased staple feeding mechanisms operating to bias staples disposed in each of said plurality of rows in a direction from said first end of said housing member toward said second end of said housing member;

selector means for alternately, selectively displacing staples disposed in all but one of said plurality of rows back away from said second end of said housing member toward said first end of said housing member;

a driving blade extending from said top of said housing member into said pathway, said driving blade having a bottom edge which is moveable between a first position and a second position, said driving blade being operable to dispense a staple disposed in said one of said plurality of rows which is not displaced back away from said second end of said housing member toward said first end of said housing member to bind a plurality of sheets of paper when said driving blade moves from said first position to said second position; and an anvil member having a top surface, said top surface of said anvil member being disposed below the portion of said pathway at said bottom and said second end of said housing member, whereby sheets of paper may be placed intermediate said bottom of said housing member at said second end thereof and said anvil member.

19. A stapler for use in binding a plurality of sheets of paper together, said stapler comprising:

a housing member having a first end and a second end and a top and a bottom, said second end of said housing member defining a pathway extending between said top of said housing member and said bottom of said housing member through which pathway staples may be dispensed;

means for storing a plurality of different sizes of staples in a plurality of rows within said housing member, said plurality of rows being arranged in a stacked array intermediate said top of said housing member and said bottom of said housing member;

selector means for allowing staples disposed in only a selected one of said plurality of rows to be disposed toward said second end of said housing member such that a staple in said selected one of said plurality of rows extends within said pathway; and means for dispensing a staple disposed within said pathway by urging the staple from said one of said plurality of rows through said pathway to bind a plurality of sheets of paper together.

* * * * *